US007765862B2

(12) United States Patent
Flaum

(10) Patent No.: US 7,765,862 B2
(45) Date of Patent: Aug. 3, 2010

(54) DETERMINATION OF FORMATION PRESSURE DURING A DRILLING OPERATION

(75) Inventor: Charles Flaum, Beijing (CN)

(73) Assignee: Schlumberger Technology Corporation, Cambridge, MA (US)

( * ) Notice: Subject to any disclaimer, the term of this patent is extended or adjusted under 35 U.S.C. 154(b) by 10 days.

(21) Appl. No.: 11/947,873

(22) Filed: Nov. 30, 2007

(65) Prior Publication Data

US 2009/0139321 A1 Jun. 4, 2009

(51) Int. Cl.
*E21B 47/06* (2006.01)

(52) U.S. Cl. ..... 73/152.51

(58) Field of Classification Search ..... 73/152.51
See application file for complete search history.

(56) References Cited

U.S. PATENT DOCUMENTS

| | | | |
|---|---|---|---|
| 3,934,468 | A | 1/1976 | Brieger |
| 4,860,581 | A | 8/1989 | Zimmerman et al. |
| 5,233,866 | A | 8/1993 | Desbrandes |
| 5,789,669 | A | 8/1998 | Flaum |
| 6,230,557 | B1 | 5/2001 | Ciglenec et al. |
| 6,832,515 | B2 | 12/2004 | Follini et al. |
| 7,024,930 | B2 | 4/2006 | Follini et al. |
| 7,036,579 | B2 | 5/2006 | Follini et al. |
| 7,114,385 | B2 | 10/2006 | Fisseler et al. |
| 7,114,562 | B2 | 10/2006 | Fisseler et al. |
| 7,117,734 | B2 | 10/2006 | Follini et al. |
| 7,210,344 | B2 | 5/2007 | Follini et al. |
| 7,263,880 | B2 | 9/2007 | Pop et al. |
| 7,290,443 | B2 | 11/2007 | Follini et al. |

(Continued)

FOREIGN PATENT DOCUMENTS

CA 2242978 A1 2/1999

(Continued)

OTHER PUBLICATIONS

Wyllie, An Investigation of the Electrokinetic Component of the Self Potential Curve, Petroleum Transactions, AIME, vol. 192, 1951, pp. 1-18.

*Primary Examiner*—Hezron Williams
*Assistant Examiner*—Rodney T Frank
(74) *Attorney, Agent, or Firm*—James McAleenan; Vincent Loccisano; Brigid Laffey

(57) ABSTRACT

A drilling operation wherein a borehole can be drilled through earth formations with a drill bit at the end of a drill string, using recirculating drilling mud that flows downward through the drill string, exits through the drill bit, and returns to the earth's surface in the annulus between the drill string and the borehole wall, at least a portion of which has a mudcake thereon, and a surface pumping system for pumping the mud to recirculate. Determining true formation pressure, including the following steps: providing a measurement device, having a probe, on the drill string; controlling the mud flow rate to obtain a first measured borehole pressure and measuring, with the probe of the measurement device, as a corresponding first probe pressure, the pressure in the formation adjacent the mudcake; controlling the mud flow rate to obtain a second measured borehole pressure and measuring, with the probe of the measurement device, as a corresponding second probe pressure, the pressure in the formation adjacent the mudcake; and deriving the true formation pressure from the first and second measured borehole pressures and the first and second probe pressures.

24 Claims, 4 Drawing Sheets

U.S. PATENT DOCUMENTS

| | | | | |
|---|---|---|---|---|
| 7,311,142 | B2 | 12/2007 | Fisseler et al. | |
| 7,331,223 | B2 | 2/2008 | Zazovsky | |
| 2005/0173113 | A1* | 8/2005 | Follini et al. | 166/250.07 |
| 2006/0129365 | A1* | 6/2006 | Hammond | 703/10 |
| 2007/0198192 | A1* | 8/2007 | Hsu et al. | 702/6 |
| 2008/0156486 | A1* | 7/2008 | Ciglenec et al. | 166/264 |

FOREIGN PATENT DOCUMENTS

| | | | |
|---|---|---|---|
| CA | 2320576 | A1 | 4/2001 |
| CA | 2389123 | A1 | 12/2002 |
| CA | 2556937 | A1 | 7/2005 |
| CA | 2491192 | A1 | 9/2005 |

* cited by examiner

DETERMINATION OF FORMATION PRESSURE DURING A DRILLING OPERATION

BACKGROUND OF THE INVENTION

1. Field of the Invention

The invention generally relates to the field of measuring while drilling of earth boreholes and, more particularly, to the determination, during a drilling operation with the drill string in a fluid-containing borehole, of virgin formation pressure of formations surrounding the borehole.

2. Background of the Invention

Existing well logging devices can provide useful information about hydraulic properties of formations, such as pressures and fluid flow rates, and can obtain formation fluid samples for uphole analysis. Reference can be made, for example, to U.S. Pat. Nos. 3,934,468 and 4,860,581. In a logging device of this general type, a setting arm or setting pistons can be used to controllably urge the body of the logging device against a side of the borehole at a selected depth. The side of the device that is urged against the borehole wall includes a packer which surrounds a probe. As the setting arm extends, the probe is inserted into the formation, and the packer then sets the probe in position and forms a seal around the probe, whereupon formation pressure can be measured and fluids can be withdrawn from the formation. The probe typically penetrates the mudcake and communicates with the formation adjacent the mudcake by abutting or slightly penetrating the formations. The pressure measured with the probe at the formation adjacent to the mudcake is sometimes called the "probe pressure" and it can be used as an indicator of the virgin formation pressure, it being understood that there will often be substantial invasion of the formations near the probe. However, the measurement of true formation pressure, especially in relatively low permeability formations, is sometimes rendered difficult or impossible by a phenomenon called "supercharging".

According to one theory, supercharging is caused by the fact that the permeability of mudcake is not exactly zero, but has some small finite value. In low permeability formations, the resistance to fluid flow due to the mudcake can be of the same order of magnitude as the resistance of the formation to accepting the fluid. Thus, a standard wireline pressure measurement, which measures the pressure difference across the mudcake, will not be sufficient to measure the pressure of virgin formation, since there remains (due to the constant fluid flow across the mudcake), a residual finite pressure difference between the formation at the mudcake interface and virgin formation far away.

As described in applicant's U.S. Pat. No. 5,798,669, an explanation of supercharging can be made by analogy to electrical current flow, since Darcy's law and Ohm's law have the same algebraic form. Reference can be made to the diagram of FIG. 1. The pressure difference between the borehole (hydrostatic) and the virgin formation is the driving potential Vbh−Vf. The mudcake is analogous to a relatively high value resistor Rmc. The formation is another resistor, Rf, in series with the mudcake. A high permeability formation is represented by a low formation resistor. In such a case Rmc>>Rf, and the whole potential drop will occur across the mudcake resistor, and a potential measurement across the mudcake Vbh−Vmc will provide the formation potential, as Vmc=Vf. For impermeable formations Rmc<<Rf, and there will be almost no potential difference observed across the mudcake, so Vmc=Vbh.

However, for low permeability formations, where Rmc and Rf are of the same order of magnitude, Vmc will be somewhere between Vbh and Vf. Since Vmc is the analog of the probe pressure measurement taken with the above-described type of logging tool, it is seen that in this case the true reservoir pressure will not be obtained by having the measurements Vbh and Vmc.

As noted in the '669 Patent, instead of making a single probe pressure measurement at a point in the well, the well hydrostatic pressure can be used as the driving potential, and additional probe pressure measurements can be made with different driving potentials. From two such measurements, when the difference in the driving pressures is of the same order of magnitude as the difference between the driving pressure and the formation pressure, the formation pressure can be determined. The technique can be extended to several measurements, to improve the precision of the result.

As described in an embodiment in the '669 Patent, there is provided a method for determining true formation pressure in formations surrounding a fluid-containing borehole having a mudcake on the surface thereof, including the following steps: with the pressure in the borehole at a first measured borehole pressure, measuring, as a first probe pressure, the pressure in the formation adjacent the mudcake; with the pressure in the borehole at a second measured borehole pressure, measuring, as a second probe pressure, the pressure in the formation adjacent the mudcake; and deriving the true formation pressure from the first and second measured borehole pressures and the first and second probe pressures.

As further described in the '669 Patent. In situations where the borehole hydrostatic pressure will naturally vary over a short period of time (for example, in certain floating rig situations), it may not be necessary to vary the hydrostatic pressure. In such cases, the readings of hydrostatic pressure as a function of time can show pressure variations, and if they are significant, the pressures measured with the probe can be utilized, in conjunction with the hydrostatic borehole pressure measurements. In other situations, the borehole hydrostatic pressure can be varied in other suitable ways, for example, increasing or decreasing pressure by pumping or by removal of fluid, although it is noted that lowering of pressure, in some circumstances, would not be recommended from a safety standpoint.

As further described in the '669 Patent, borehole pressure variation can also be localized to the region in which measurements are being made, using dual packers. The pressure within the isolated region of the borehole can be modified by pumping to or from (preferably to) the isolated region. As shown in the '669 Patent, this is implemented by providing packers and a pump-out module as part of the apparatus used to perform the pressure measurements.

It would be advantageous to have a technique and apparatus that is capable of efficiently determining, while drilling, with the drill string in the borehole, the true formation pressure, even under conditions where supercharging is occurring, and it is among the objectives of the invention to provide this capability.

SUMMARY OF THE INVENTION

According to an embodiment of the invention, a method relates to a drilling operation wherein a borehole is being drilled through earth formations with a drill bit at the end of a drill string, using recirculating drilling mud that flows downward through the drill string, exits through the drill bit, and returns to the earth's surface in the annulus between the drill string and the borehole wall, at least a portion of which has a mudcake thereon, and a surface pumping system for pumping the mud to recirculate. Further, the method can set forth for determining true formation pressure, including the following steps: providing a measurement device, having a probe, on the drill string; controlling the mud flow rate to obtain a first measured borehole pressure and measuring, with the probe of the measurement device, as a corresponding first probe pressure, the pressure in the formation adjacent the mudcake; controlling the mud flow rate to obtain a second measured borehole pressure and measuring, with the probe of the measurement device, as a corresponding second probe pressure, the pressure in the formation adjacent the mudcake; and deriving the true formation pressure from the first and second measured borehole pressures and the first and second probe pressures.

According to another embodiment of the invention, a method includes the step of providing a measurement device on the drill string that comprises providing the measurement device near the drill bit. In this particular embodiment, the step of controlling the flow rate to obtain a second measured borehole pressure and measuring, with the probe of the measurement device, as a corresponding second probe pressure, the pressure in the formation adjacent the mudcake, includes controlling the flow rate to be different than the flow rate used to obtain the first measured borehole pressure.

According to a feature of the invention, the method includes the steps of controlling the mud flow rate are implemented, under control of a processor, from the earth's surface.

According to an embodiment of the invention, a method for determining true formation pressure while drilling in a subterranean environment from using recirculation fluid that flows through a drill string and a void between the drill string and a formation being drilled. The method includes the step of providing a measurement device, having a probe, on the drill string. The method further provides the step of providing a drill bit on a lower end of the drill string such that said measurement device is approximate the drill bit. Further, controlling a mud flow rate with a controlling means to obtain a first measured borehole pressure and measuring, with the probe of said measurement device, as a corresponding first probe pressure, the pressure in the formation adjacent a mudcake located approximate the void. The method also includes the step of controlling the mud flow rate to obtain a second measured borehole pressure and measuring, with the probe of said measurement device, as a corresponding second probe pressure, the pressure in the formation adjacent said mudcake. Finally, the method includes the step of deriving the true formation pressure from said first and second measured borehole pressures and said first and second probe pressures, wherein the derived true formation pressure is communicated to a bottom hole assembly.

According to an aspect of the invention, the invention further comprising repeating the method at a number of different depth levels in the drilled formation, to obtain true formation pressure at said number of different depth levels.

According to an aspect of the invention, the invention further comprising repeating the method at a number of different depth levels in the drilled formation, to obtain true formation pressure at said number of different depth levels, and producing from said number of obtained true formation pressures, a log of true formation pressure as a function of depth level.

Further features and advantages of the invention will become more readily apparent from the following detailed description when taken in conjunction with the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to an embodiment of the invention, the invention relates to a drilling operation wherein a borehole is being drilled through earth formations with a drill bit at the end of a drill string, using recirculating drilling mud that flows downward through the drill string, exits through the drill bit, and returns to the earth's surface in the annulus between the drill string and the borehole wall, at least a portion of which has a mudcake thereon, and a surface pumping system for pumping the mud to recirculate.

Figure 2:
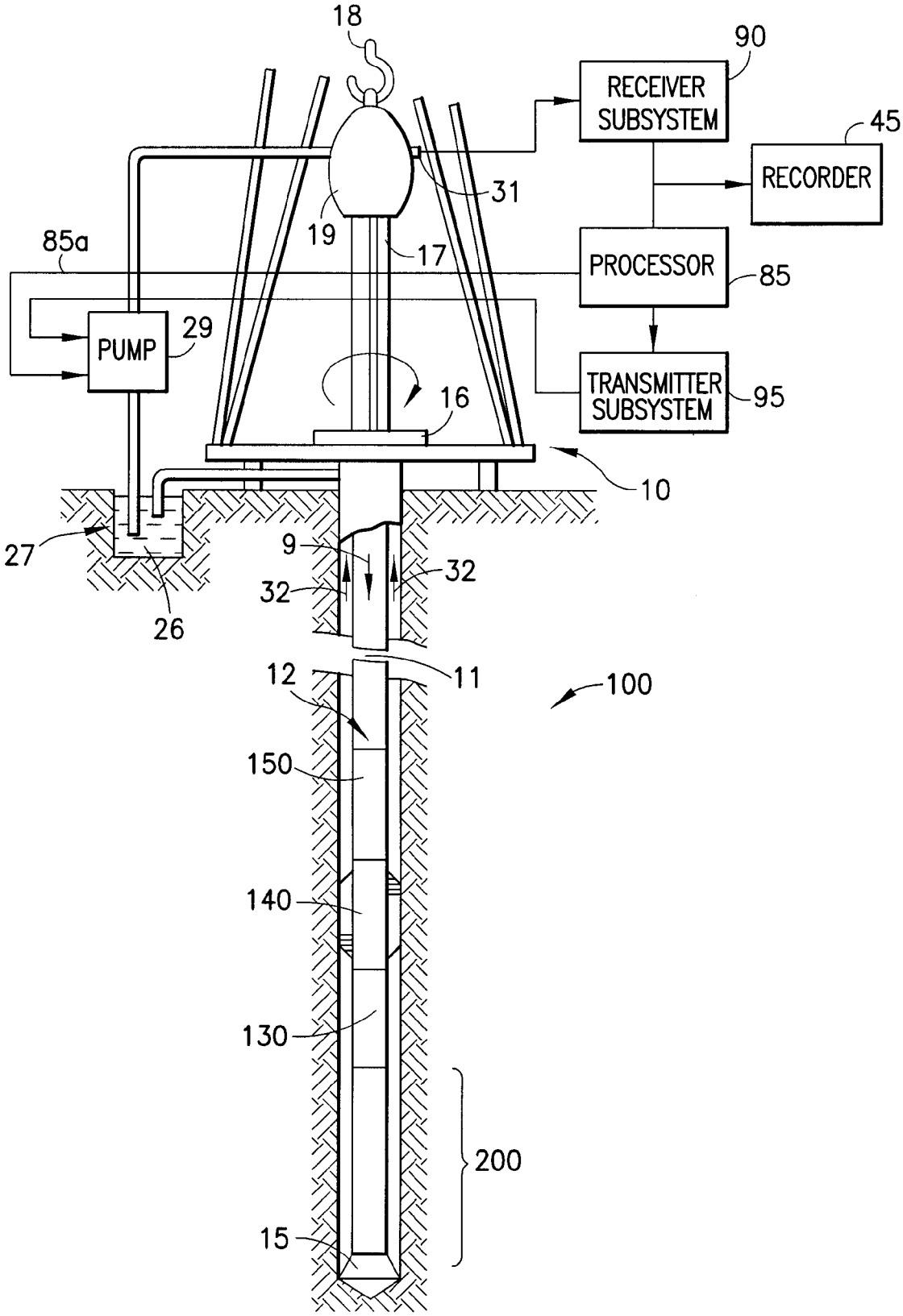
FIG. 2 illustrates according to an embodiment of the invention, a schematic diagram, partially in block form, of a drilling apparatus and a logging while drilling system that can be used in practicing embodiments of the invention.

Referring to FIG. 2, there is illustrated a logging-while-drilling apparatus of a type which can be used in practicing embodiments of the invention. [As used herein, and unless otherwise specified, logging-while-drilling (sometimes called measuring-while-drilling) is intended to include the taking of measurements in an earth borehole, with the drill bit and at least some of the drill string in the borehole, during drilling, pausing, and/or tripping.] A platform and derrick 10 are positioned over a borehole 11 that is formed in the earth by rotary drilling. A drill string 12 is suspended within the borehole and includes a drill bit 15 at its lower end. The drill string 12 and the drill bit 15 attached thereto are rotated by a rotating table 16 (energized by means not shown) which engages a kelly 17 at the upper end of the drill string. The drill string is suspended from a hook 18 attached to a traveling block (not shown). The kelly is connected to the hook through a rotary swivel 19 which permits rotation of the drill string relative to the hook. Alternatively, for example, the drill string 12 and drill bit 15 may be rotated from the surface by a "top drive" type of drilling rig. Drilling fluid or mud 26 is contained in a pit 27 in the earth. A controllable pump 29 pumps the drilling mud into the drill string via a port in the swivel 19 to flow downward (arrow 9) through the center of drill string 12. The drilling mud exits the drill string via ports in the drill bit 15 and then circulates upward in the region between the outside of the drill string and the periphery of the borehole, commonly referred to as the annulus, as indicated by the flow arrows 32. The drilling mud thereby lubricates the bit and carries formation cuttings to the surface of the earth. The drilling mud is returned to the pit 27 for recirculation after suitable conditioning. An optional directional drilling assembly (not shown) with a mud motor having a bent housing or an offset sub could also be employed. A roto-steerable system (not shown) could also be used.

Mounted within the drill string 12, preferably near the drill bit 15, is a bottom hole assembly, generally referred to by reference numeral 100, which includes capabilities for measuring, for processing, and for storing information, and for communicating with the earth's surface. [As used herein, "near the drill bit" means within several drill collar lengths from the drill bit.] The assembly 100 includes a measuring and local communications apparatus 200, parts of which are described further hereinbelow. In the example of the illustrated bottom hole arrangement, a drill collar 130 and a stabilizer collar 140 are shown successively above the apparatus 200. The collar 130 may be, for example, a pony collar or a collar housing measuring apparatus.

Located above stabilizer collar 140 is a surface/local communications subassembly 150. The subassembly 150 can include any suitable type of wired and/or wireless downhole communication system. Known types of equipment include a toroidal antenna or electromagnetic propagation techniques for local communication with the apparatus 200 (which also has similar means for local communication) and also an acoustic communication system that communicates with a similar system at the earth's surface via signals carried in the drilling mud. Alternative techniques for communication with the surface, for example wired drillpipe, can also be employed. The surface communication system in subassembly 150 includes an acoustic transmitter which generates an acoustic signal in the drilling fluid that is typically representative of measured downhole parameters. One suitable type of acoustic transmitter employs a device known as a "mud siren" which includes a slotted stator and a slotted rotor that rotates and repeatedly interrupts the flow of drilling mud to establish a desired acoustic wave signal in the drilling mud. The driving electronics in subassembly 150 may include a suitable modulator, such as a phase shift keying (PSK) modulator, which conventionally produces driving signals for application to the mud transmitter. These driving signals can be used to apply appropriate modulation to the mud siren. The generated acoustic mud wave travels upward in the fluid through the center of the drill string at the speed of sound in the fluid. The acoustic wave is received at the surface of the earth by transducers represented by reference numeral 31. The transducers, which are, for example, piezoelectric transducers, convert the received acoustic signals to electronic signals. The output of the transducers 31 is coupled to the uphole receiving subsystem 90 which is operative to demodulate the transmitted signals, which can then be coupled to processor 85 and recorder 45 which, inter alia, can produce recorded logs. An uphole transmitting subsystem 95 can also be provided, and can control interruption of the operation of pump 29 in a manner which is detectable by the transducers in the subassembly 150, so that there is two way communication between the subassembly 150 and the uphole equipment. The subsystem 150 may also conventionally include acquisition and processor electronics comprising a microprocessor system (having for example, an associated memory, clock and timing circuitry, and interface circuitry, and the like) capable of storing data from a measuring apparatus, processing the data and storing the results, and coupling any desired portion of the information it contains to the transmitter control and driving electronics for transmission to the surface. A battery may provide downhole power for this subassembly. As known in the art, a downhole generator (not shown) such as a so-called "mud turbine" powered by the drilling mud, can also be utilized to provide power, for immediate use or battery recharging, during drilling. As above noted, alternative techniques can be employed for communication with the surface of the earth. Also, while it is preferred to obtain the true formation pressure information in substantially real time, it will be understood that the measurements can alternatively be stored downhole and recovered when the logging device is brought to the earth's surface.

Figure 3:
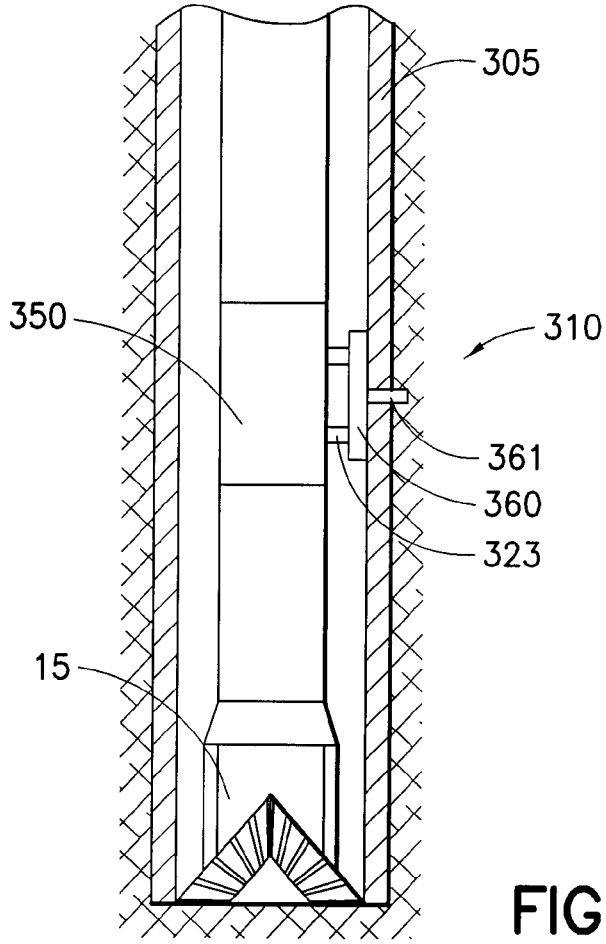
FIG. 3 illustrates according to an embodiment of the invention, a diagram showing a logging device that is part of the FIG. 2 equipment, and which can be used in practicing embodiments of the invention.

FIG. 3 shows a portion of a logging device 310 which, in an embodiment hereof, is part of the measuring and local communications apparatus 200 (of FIG. 2). In particular, FIG. 3 shows the drill bit 15 (of FIG. 2) and one or more arms 323, such that the one or more arms 323 can be mounted on pistons which extend, e.g. under control from the surface, to set the tool. The logging device includes one or more probe modules that include a probe assembly 360 which is movable with a probe actuator (not separately shown) and includes a probe 361 that is outwardly displaced into contact with the borehole wall, piercing the mudcake 305 and communicating with the formations. The equipment and methods for taking individual hydrostatic pressure measurements and/or probe pressure measurements are well known in the art, and the logging device 310 is provided with these known capabilities. Probe 361 is illustrated as communicating with a block 350 that represents the subsystem of gauges and associated electronics for measuring the desired pressures and producing electrical signals representative thereof that can be communicated to the earth's surface.

Figure 1:
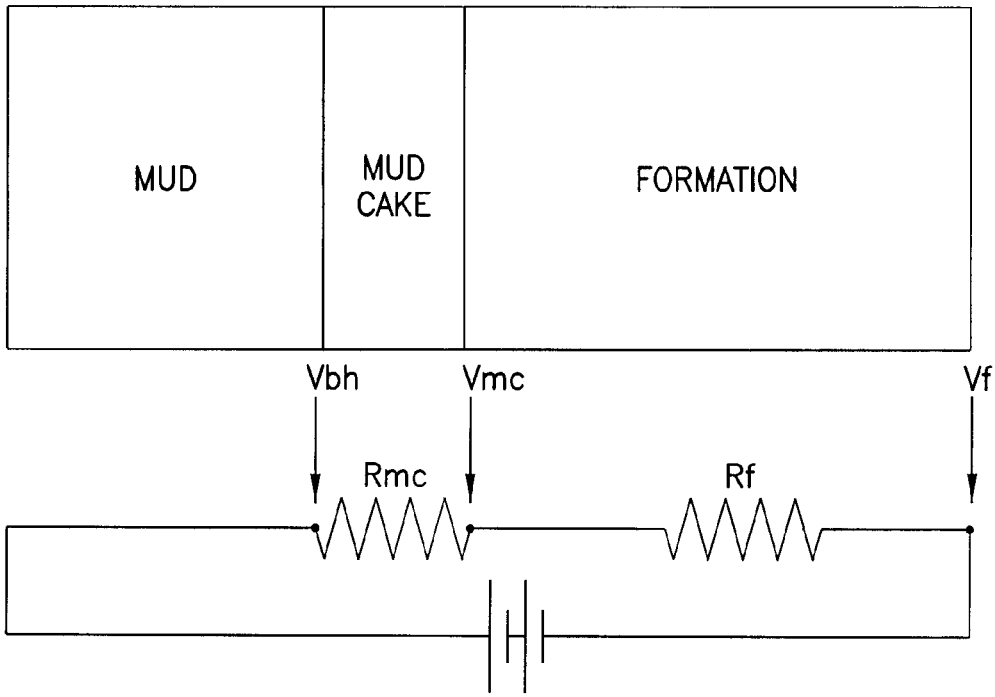
FIG. 1 PRIOR ART
FIG. 1 illustrates according to an embodiment of the invention, a circuit diagram that is a simplified analog of the borehole, mudcake, and formation.

As discussed above, an explanation of supercharging can be made by analogy to electrical current flow, since Darcy's law and Ohm's law have the same algebraic form. (see FIG. 1 and U.S. Pat. No. 5,789,669). The pressure difference between the borehole (hydrostatic) and the virgin formation is the driving potential Vbh−Vf. The mudcake is analogous to a relatively high value resistor Rmc. The formation is another resistor, Rf, in series with the mudcake. A high permeability formation is represented by a low formation resistor. In such a case Rmc>>Rf, and the whole potential drop will occur across the mudcake resistor, and a potential measurement across the mudcake Vbh−Vmc will provide the formation potential, as Vmc=Vf. For impermeable formations Rmc<<Rf, and there will be almost no potential difference observed across the mudcake, so Vmc=Vbh.

However, as previously noted, for low permeability formations, where Rmc and Rf are of the same order of magnitude, Vmc will be somewhere between Vbh and Vf. Since Vmc is the analog of the probe pressure measurement taken with the type of logging tool described in the Background portion hereof, it is seen that in this case the true reservoir pressure will not be obtained by having the measurements Vbh and Vmc.

Using the analogy to electrical current, since the current (fluid flow) across the mudcake, across Rmc, is the same as the current into the formation, across Rf, one can say that $$(Vbh-Vf)/(Rmc+Rf)=(Vbh-Vmc)/Rmc \quad (1)$$

For two different Vbh measurements Vbh1 and Vbh2, with corresponding Vmc1 and Vmc2, the relationships are:

$$(Vbh-Vf)/(Rmc+Rf)=(Vbh1-Vmc1)/Rmc \quad (2)$$

$$(Vbh2-Vf)/(Rmc+Rf)=(Vbh2-Vmc2)/Rmc \quad (3)$$

Dividing equation (2) by equation (3) gives $$(Vbh1-Vf)/(Vbh2-Vf)=(Vbh1-Vmc1)/(Vbh2-Vmc2) \quad (4)$$

Vf can be obtained by solving equation (4), as all other V's are either known or measured:

$$Vf=(\text{Ratio}*Vbh2-Vbh1)/(\text{Ratio}-1) \quad (5)$$

Where:

$$\text{Ratio}=(Vbh1-Vmc1)/(Vbh2-Vmc2) \quad (6)$$

In this analogy V's are the pressures; that is, Vbh is the pressure in the borehole ($P_{bh}$), Vf is the true formation pressure ($P_f$), and Vmc is the probe derived pressure ($P_{pr}$).

Figure 4:
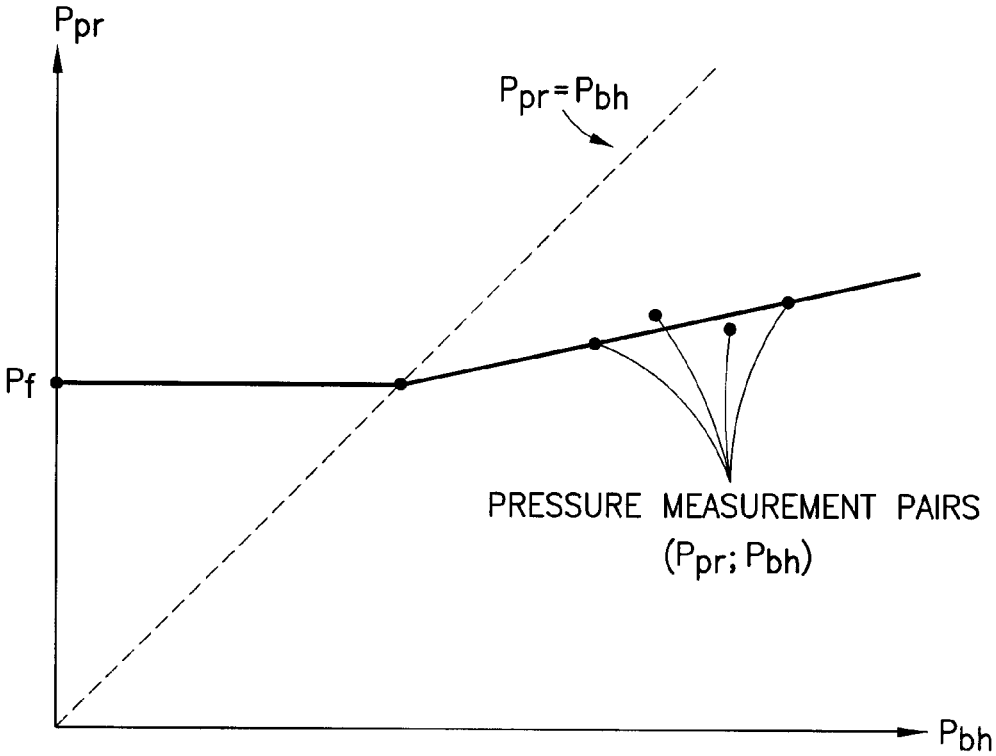
FIG. 4 is a graph of probe pressure versus borehole pressure that is useful in understanding operation of an embodiment or embodiments of the invention.

The described approach can be extended to more than two measurements, to improve the precision of the result. In this case, the $P_f$ can be obtained, for example, graphically, as shown in FIG. 4. On the plot of $P_{pr}$ versus $P_{bh}$, which contains pressure measurement data pair points ($P_{bh}$, $P_{pr}$), the true formation pressure $P_f$ is obtained at the point where the line drawn through the data points (for example a straight line using a least squares fit implemented by the processor) crosses the $P_{pr}=P_{bh}$ line, since under this condition there would be no flow through the mudcake so $P_f=P_{bh}$. Although an embodiment hereof utilizes a linear relationship, it will be understood that the principles of the invention are also applicable if the relationship is other than linear; namely, a non-linear relationship that could, for example, be determined empirically or by physical modeling. Accordingly, a suitable curved line or function could alternatively be used.

Figure 5:
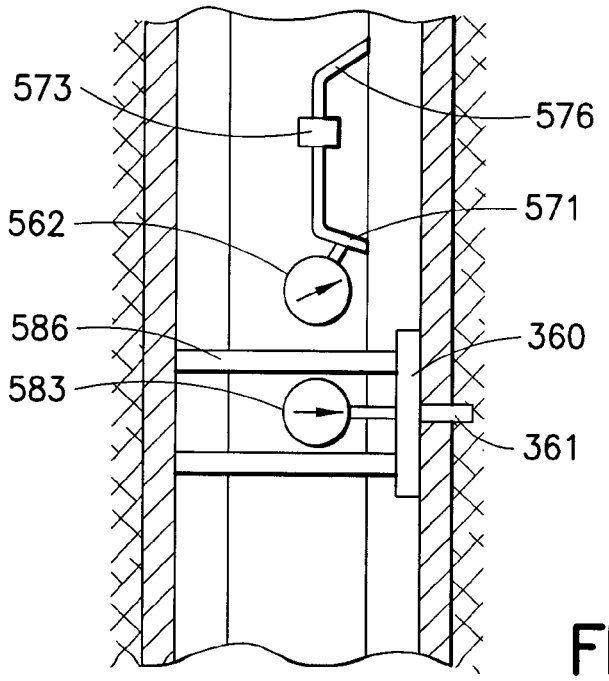
FIG. 5 is a schematic diagram showing further details of the apparatus of FIG. 3, and which can be used in practicing embodiments of the invention.

Referring to FIG. 5, there is shown further detail of an embodiment of the logging while drilling tool 350 of FIG. 3. The borehole pressure in the region of the tool is measured by pressure gauge 562, via line 571, which is also coupled with a pump-out module 573 and line 576. The pump-out module 573 can be of known type (see, for example, U.S. Pat. No. 4,860,581). The probe assembly 360 and probe 361 are set by setting pistons 586, and the probe pressure is measured by pressure gauge 583. As first described hereinabove, the borehole pressure is changed, for example under control of processor 85 (see line 85*a* of FIG. 2), by controlling the mud flow rate at the earth's surface. For each of a plurality of downhole borehole pressures, a corresponding probe pressure is measured. In this manner, and in this particular embodiment, the true formation pressure is determined using the technique described in conjunction with FIGS. 1 and 4.

Figure 6:
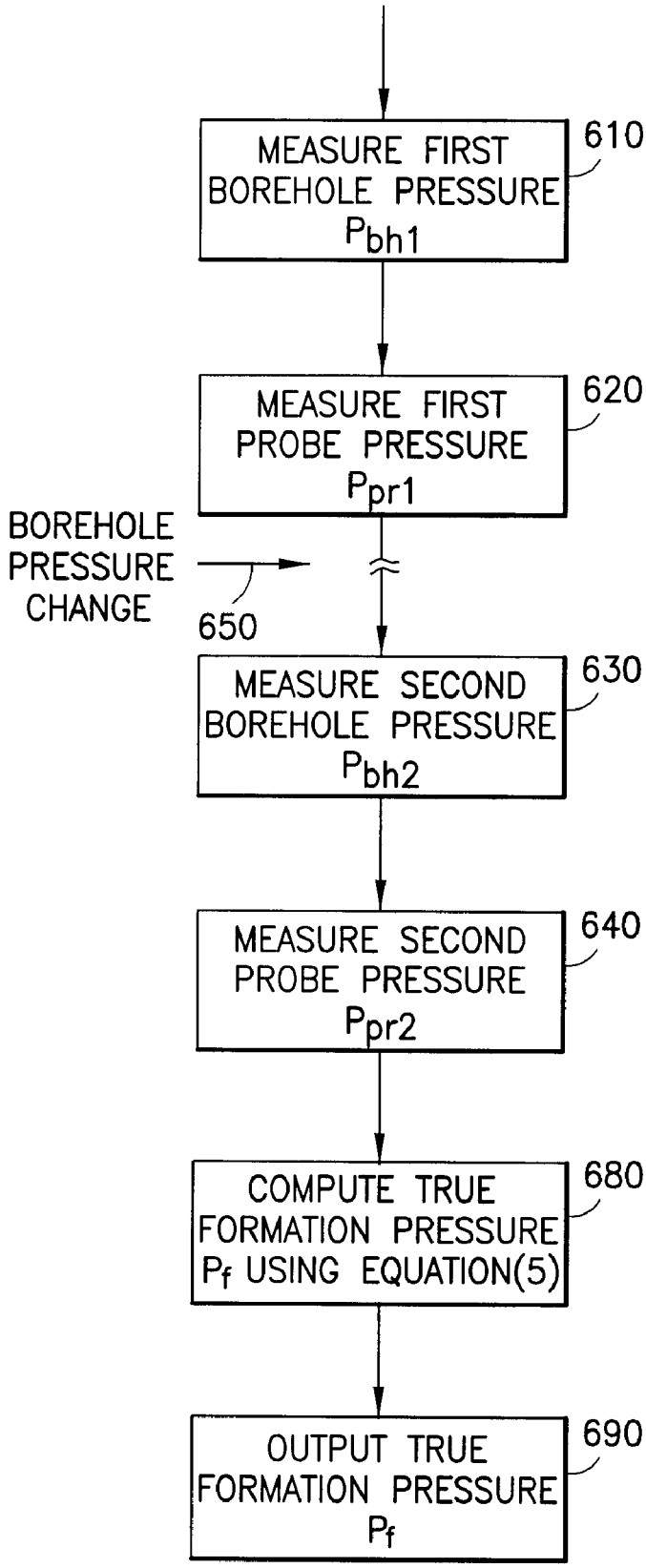
FIG. 6 is a flow diagram that represents steps of a technique or routine, such as for controlling a processor, in accordance with an embodiment or embodiments of the invention.

Referring to FIG. 6, there is shown a diagram of the steps that can be implemented in practicing an embodiment of the invention. For example, the technique can be performed under processor control (either from an uphole or downhole processor), or by a combination of processor control and uphole operator control. The block 610 represents measuring (and, in all cases, storing) of a first borehole pressure, $P_{bh1}$, and the block 620 represents the measuring of a first probe pressure $P_{pr1}$. The pressure measurements can be implemented in the manner previously described. Next, the arrow 650 represents the change in borehole pressure which, in this particular embodiment, is implemented by controlling the mud flow rate. The block 630 represents measurement of the second borehole pressure $P_{bh2}$, and the block 640 represents measurement of a second probe pressure $P_{pr2}$. Then, the block 680 represents computation of the true formation pressure using the measured pressures and equation (5) above, and the block 690 represents reading out of the true formation pressure (Pf).

Several pressure measurement pairs ($P_{bhk}$, $P_{prk}$) can also be utilized to determine the relationship therebetween, and extrapolation can then be used to determine the true formation pressure. A line or curve can be fit through the data points, as described above, for example in conjunction with FIG. 3, to obtain true formation pressure (not shown). As noted above, reference can also be made to U.S. Pat. No. 5,789,669.

The invention has been described with reference to particular preferred embodiments, but variations within the spirit and scope of the invention will occur to those skilled in the art. For example, it will be understood that the logging while drilling tool of the illustrated embodiment can take other suitable forms. Further, it is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for determining true formation pressure while drilling in an earth formation, using recirculating fluid that flows downward through a drill string and returns to a surface in a void between the drill string and the earth formation that has a portion of mudcake thereon, the method comprising:

a) providing a measurement device with a probe on the drill string;

b) controlling a mud flow rate to obtain a first measured borehole pressure and measuring a corresponding first probe pressure with the probe wherein the corresponding first probe pressure is the pressure in the earth formation adjacent the mudcake;

c) controlling the mud flow rate to obtain a second measured borehole pressure and measuring a corresponding second probe pressure with the probe wherein the corresponding second probe pressure is the pressure in the earth formation adjacent the mudcake;

d) deriving the true formation pressure from calculating a first ratio from the first and second measured borehole pressures and the first and second probe pressures.

2. The method according to claim 1, wherein step (a) further comprises providing the measurement device near a drill bit located approximate an end of the drill string.

3. The method according to claim 1, wherein step (c) further includes controlling the mud flow rate to be different than the mud flow rate used to obtain the first measured borehole pressure.

4. The method according to claim 1, wherein steps (b) and (c) of controlling the mud flow rate are implemented from a earth's surface.

5. The method according to claim 1, wherein steps (b) and (c) of controlling the mud flow rate are implemented and under control of a processor.

6. The method according to claim 3, wherein steps (b) and (c) of controlling the mud flow rate are implemented under control of a processor from a earth's surface.

7. The method according to claim 1, wherein steps (b) and (c) are performed while the probe on the drill string is stationary or non-rotating.

8. The method according to claim 5, wherein steps (b) and (c) are performed while the probe on the drill string is stationary or non-rotating.

9. The method according to claim 1, wherein the first and second measured borehole pressures are $P_{bh1}$ and $P_{bh2}$, respectively, and wherein the first and second probe pressures are $P_{pr1}$ and $P_{pr2}$, and wherein step (d) further comprises deriving the true formation pressure as $$P_f=(\text{Ratio}*P_{bh2}-P_{bh1})/(\text{Ratio}-1)$$

where $$\text{Ratio}=(P_{bh1}-P_{pr1})/(P_{bh2}-P_{pr2}).$$

10. The method according to claim 1, further comprising repeating steps (a) to (d) at a number of different depth levels in a borehole of the earth formation, to obtain true formation pressure at the number of different depth levels.

11. The method according to claim 5, further comprising repeating (a) to (e) at a number of different depth levels in a borehole of the earth formation, to obtain true formation pressure at the number of different depth levels.

12. The method according to claim 1, further comprising repeating steps (a) to (d) at a number of different depth levels in a borehole of the earth formation, to obtain true formation pressure at the number of different depth levels, and producing from the number of obtained true formation pressures, a log of true formation pressure as a function of depth level.

13. The method according to claim 5, further comprising repeating steps (a) to (d) at a number of different depth levels in a borehole of the earth formation, to obtain true formation pressure at the number of different depth levels, and producing from the number of obtained true formation pressures, a log of true formation pressure as a function of depth level.

14. A method for determining true formation pressure while drilling in an earth formation, using recirculating fluid that flows downward through a drill string and returns to a surface in a void between the drill string and the earth formation that has a portion of mudcake thereon, the method comprising:

a) providing a measurement device having a probe on the drill string;

b) using a surface pumping system for controlling the mud flow rate to obtain at least three measured borehole pressures and measuring at least three corresponding measured probe pressures with the probe wherein the corresponding at least three probe pressures relate to the pressure in the earth formation adjacent the mudcake;

c) using the at least three corresponding measured probe pressures as a function of the at least three measured borehole pressures to obtain at least three pressure measurement data pair points, and plotting the at least three pressure measurement data pair points;

d) fitting a line through the at least three pressure measurement pair data points, extrapolating to a point along the fitted line where the probe pressure equals the borehole pressure; and e) obtaining the true formation pressure which is equal to the probe pressure at the point along the fitted line where the probe pressure equals the borehole pressure.

15. The method according to claim 14, wherein step (a) further includes providing a measurement device on the drill string comprises providing the measurement device near the drill bit.

16. The method according to claim 14, wherein step (b) of controlling the mud flow rate is implemented under control of a processor from a earth's surface.

17. The method according to claim 14, wherein steps (a) to (e) are performed while the probe on the drill string is stationary or non-rotating.

18. The method according to claim 14, further comprising repeating steps (a) to (e) at a number of different depth levels in the borehole, to obtain true formation pressure at the number of different depth levels.

19. The method according to claim 14, further comprising repeating steps (a) to (e) at a number of different depth levels in the borehole, to obtain true formation pressure at the number of different depth levels, and producing from the number of obtained true formation pressures, a log of true formation pressure as a function of depth level.

20. A method for determining true formation pressure while drilling in a subterranean environment from using recirculation fluid that flows through a drill string and a void between the drill string and the subterranean environment being drilled, the method comprising the steps of:

a) providing a measurement device having a probe on the drill string;

b) providing a drill bit on a the drill string such that the measurement device is approximate the drill bit;

c) using a controlling means for controlling a mud flow rate to obtain a first measured borehole pressure and a corresponding first measured probe pressure with the probe, wherein the measured pressures are in the subterranean environment adjacent a mudcake located approximate the void;

d) using the controlling means for controlling the mud flow rate to obtain a second measured borehole pressure and a corresponding second measured probe pressure with the probe, wherein the measured pressures are in the subterranean environment adjacent the mudcake; and e) deriving the true formation pressure from the first and second measured borehole pressures and the first and second measured probe pressures, wherein the derived true formation pressure is communicated to a bottom hole assembly.

21. The method according to claim 20, further comprising repeating steps (a) to (e) at one or more depth levels in the subterranean environment, to obtain true formation pressure at the one or more depth levels.

22. The method according to claim 20, further comprising repeating steps (a) to (e) at one or more depth levels in the subterranean environment, to obtain true formation pressure at said one or more depth levels, and producing from the number of obtained true formation pressures, a log of true formation pressure as a function of depth level.

23. The method according to claim 20, wherein step (e) further comprises:

e) calculating a first ratio from the first and second measured borehole pressures and the first and second probe pressures and calculating a second ratio from subtracting the calculated first ratio less one; and f) deriving the true formation pressure from multiplying the first ratio with a sum of the second measured borehole pressure less the first measured borehole pressure and then dividing by the second ratio, wherein the derived true formation pressure is communicated to a bottom hole assembly.

24. A method for determining true formation pressure while drilling in a formation, wherein the true formation pressure is determined from using recirculation fluid flowing downward through a drill string and returning to a surface in a void between the drill string and the formation that has a mudcake thereon, the method comprising:

a) providing a measurement device with a probe on the drill string;

b) using a controllable pump with a processor for controlling a mud flow rate to obtain a first measured borehole pressure and a corresponding first measured probe pressure with the probe, wherein the corresponding first measured probe pressure is the pressure in the formation adjacent the mudcake;

c) using the controllable pump with a processor for controlling a mud flow rate to obtain a second measured borehole pressure and a corresponding second measured probe pressure with the probe wherein the corresponding second measured probe pressure is the pressure in the formation adjacent the mudcake;

d) calculating a first ratio from the first and second measured borehole pressures and the first and second measured probe pressures; and e) deriving the true formation pressure from multiplying the first ratio with a sum of the second measured borehole pressure less the first measured borehole pressure, then dividing by a sum of the first ratio less one.

* * * * *